US007008173B2

(12) United States Patent
Gabrys et al.

(10) Patent No.: US 7,008,173 B2
(45) Date of Patent: Mar. 7, 2006

(54) HIGH ENERGY CONTAINMENT DEVICE AND TURBINE WITH SAME

(75) Inventors: Jonathan W. Gabrys, Wynnewood, PA (US); Christopher J. Felker, Exton, PA (US)

(73) Assignee: The Boeing Company, Chicago, IL (US)

( * ) Notice: Subject to any disclaimer, the term of this patent is extended or adjusted under 35 U.S.C. 154(b) by 87 days.

(21) Appl. No.: 10/630,500

(22) Filed: Jul. 30, 2003

(65) Prior Publication Data

US 2005/0025615 A1 Feb. 3, 2005

(51) Int. Cl.
*F01D 21/00* (2006.01)

(52) U.S. Cl. ..... 415/9; 74/609

(58) Field of Classification Search ..... 415/9, 415/173.4, 174.4; 60/39.091, 223; 74/572, 74/573 R, 574, 606 R, 608, 609, 572.1, 572.2; 464/101; 192/208, 70.17

See application file for complete search history.

(56) References Cited

U.S. PATENT DOCUMENTS

| | | | | |
|---|---|---|---|---|
| 1,698,514 | A | | 1/1929 | Schmidt |
| 3,261,228 | A | * | 7/1966 | Rothman ..... 415/9 |
| 3,534,807 | A | | 10/1970 | Bracken, Jr. |
| 3,602,602 | A | | 8/1971 | Motta |
| 4,306,838 | A | | 12/1981 | Trainer |
| 4,339,874 | A | | 7/1982 | McCarty et al. |
| 4,359,912 | A | | 11/1982 | Small |
| 4,377,370 | A | | 3/1983 | Porcelli |
| 4,730,154 | A | | 3/1988 | Pinson |
| 4,735,382 | A | | 4/1988 | Pinson |
| 4,926,107 | A | | 5/1990 | Pinson |
| 5,012,216 | A | | 4/1991 | Jin |
| 5,124,605 | A | | 6/1992 | Bitterly et al. |
| 5,126,317 | A | | 6/1992 | Agarwala |
| 5,159,219 | A | | 10/1992 | Chu et al. |
| 5,163,809 | A | | 11/1992 | Akgun et al. |
| 5,209,461 | A | | 5/1993 | Whightsil, Sr. |
| 5,247,853 | A | | 9/1993 | Dalebout |
| 5,387,451 | A | | 2/1995 | Miller |
| 5,437,538 | A | | 8/1995 | Mitchell |
| 5,513,498 | A | | 5/1996 | Ackermann et al. |
| 5,551,318 | A | | 9/1996 | Fukushima |
| 5,563,565 | A | | 10/1996 | Hull |
| 5,692,414 | A | | 12/1997 | Gregoire |
| 5,784,926 | A | | 7/1998 | Maass |
| 6,182,531 | B1 | | 2/2001 | Gallagher et al. |

* cited by examiner

*Primary Examiner*—Christopher Verdier
(74) *Attorney, Agent, or Firm*—Alston & Bird LLP

(57) ABSTRACT

A containment device for use in retaining debris material traveling radially outward in a rotary device is provided as is a turbine having a containment device. The containment device includes an outer ring that extends generally circumferentially and defines an inner surface directed radially inward. A plurality of energy absorption elements are disposed on the inner surface of the outer ring. Each absorption element extends both radially inward and circumferentially so that each absorption element is configured to be plastically deformed radially outward by debris material impacting the absorption element. Each absorption element can include a base and a cap, the base extending in a generally radial direction and the cap being connected to the radially inward end of the respective base and defining an angle therewith.

23 Claims, 2 Drawing Sheets

HIGH ENERGY CONTAINMENT DEVICE AND TURBINE WITH SAME

BACKGROUND OF THE INVENTION

1) Field of the Invention

The present invention relates to a device for containing material released by or into a rotary device such as a turbine.

2) Description of Related Art

Many rotary devices include a surrounding structure for containing fragments that are released by the device during a failure. For example, a conventional rotary device such as a flywheel has a housing that surrounds the flywheel. The housing can be a strong, rigid structure designed to withstand the impact of pieces, or fragments, of the flywheel that are released if the flywheel breaks while operating at a high rotational speed. Due to the high speed and/or mass of conventional rotary devices, the fragments released during failure can have significant kinetic energy. Therefore, the housing must be strong in order to contain the fragments, typically requiring a thick housing that adds weight and cost to the device.

U.S. Pat. No. 6,182,531, titled "Containment Ring for Flywheel Failure," which issued Feb. 6, 2001, describes a containment vessel that includes an outer ring with a plurality of inner shaped elements that produce an inner ring layer. The inner shaped elements are juxtapositioned axially along the inner periphery of the outer ring and configured to produce hollow cells that plastically deform to absorb the energy from an impact of a high energy material fragment, such as are produced during catastrophic failure of a flywheel. The inner shaped elements are configured to deform at a sufficiently fast rate to prevent the inner shaped elements from rupturing or buckling.

An increased likelihood of piercing or otherwise damaging a housing or containment vessel exists where the rotary device has sharp edges extending radially outward. However, even where the rotary device does not have sharp outer edges, sharp edges can be formed if the rotary device fails. For example, typical flywheels that are used for energy storage often fail by breaking into three segments. Each segment, which can have sharp edges at the point of breaking, typically rotates as the segment moves radially outward. The rotation and path of travel of each segment are determined in part by the speed of the flywheel, the material of the flywheel, the size of the segment, and the location of the center of mass of the segment. The housing or other containment vessel for a flywheel is typically located near the flywheel, as illustrated in the figures of U.S. Pat. No. 6,182,531. Thus, only limited rotation of the segments can occur before the segments collide with the housing, thereby limiting the possibility that the broken edges of the segments will contact the housing. On the other hand, if the housing or other containment vessel is located some significant distance from the flywheel or other high energy rotary device, piercing and other damage is more likely to occur.

Thus, there exists a need for an improved containment device that can contain materials released by or into a rotary device, and a rotary turbine with such a containment device. The containment device should be able to contain materials with significant kinetic energy. Further, the containment device preferably should reduce the likelihood of piercing or other damage that results from materials that define sharp edges or points.

BRIEF SUMMARY OF THE INVENTION

The present invention provides a containment device for use in retaining debris material traveling radially outward in a rotary device such as a turbine. The containment device includes an outer ring that extends generally circumferentially and a plurality of energy absorption elements disposed on an inner surface of the outer ring. Each absorption element extends radially inward and circumferentially and is configured to be plastically deformed radially outward (and axially once radial deformation has occurred) by debris material impacting the absorption element. Further, each absorption element can be formed of a base and a cap, the base extending generally radially inward from the outer ring and the cap being connected to the base and defining an angle therebetween.

According to one embodiment of the invention, each absorption element extends circumferentially to at least partially overlap an adjacent one of the absorption elements. The cap of each absorption element can extend circumferentially at least to overlap the first end of the cap of an adjacent one of the absorption elements. According to one aspect of the invention, the angle of each base, relative to a tangential direction of the outer ring, is between about 35 and 95 degrees, and the angle of the cap relative to the tangential direction is between about 0 and 45 degrees.

Each absorption element can extend generally in an axial direction of the outer ring. In addition, the absorption elements can be formed of carbon steel, stainless steel, or Inconel®, and the caps, which can be thicker than the bases, can be welded thereto. Further, according to one aspect of the invention, the distance between the absorption elements, e.g., the caps, and an arc defined by the outermost edge of a rotating element therein, is at least about 1/10 of the diameter of the rotating element.

The present invention also provides a turbine with a containment device for containing debris material. The turbine includes a rotatable turbine rotor configured to rotate about an axis of rotation and at least one turbine blade connecting to the turbine rotor and configured to rotate about the axis of rotation with the turbine rotor. The containment device can include an outer ring and a plurality of absorption elements, as described above. The absorption elements can be substantially parallel and extend generally in the axial direction of the rotor, and the outer ring and the absorption elements can be longer in the axial direction than the rotor and blades.

Thus, the containment device of the present invention can contain debris released by or into a rotary device, including such materials having high kinetic energy. In addition, the containment device reduces the likelihood of piercing or other damage that results from debris that defines sharp edges or points.

BRIEF DESCRIPTION OF THE SEVERAL VIEWS OF THE DRAWINGS

Figure 1:
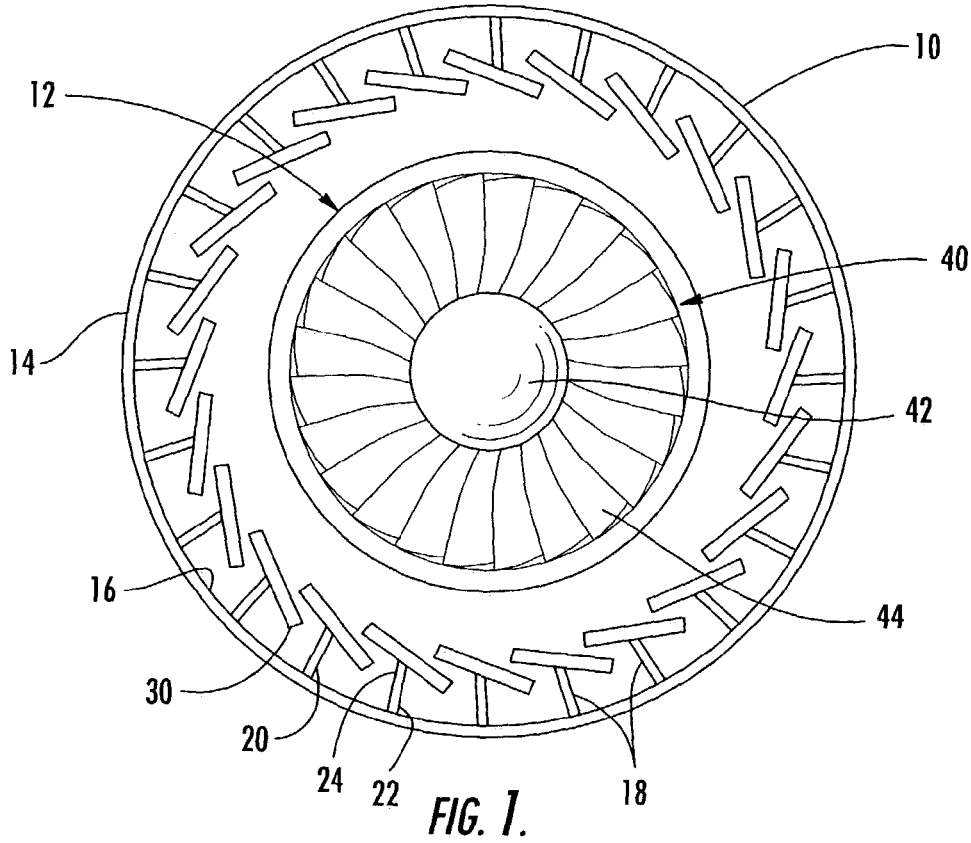
Figure 2:
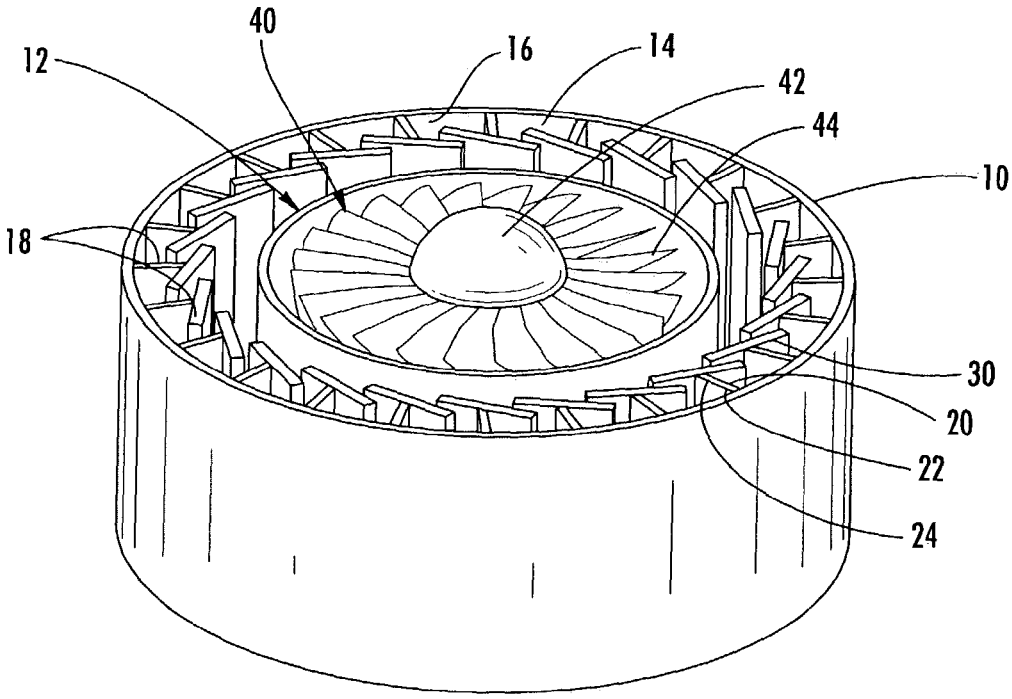
Figure 3:
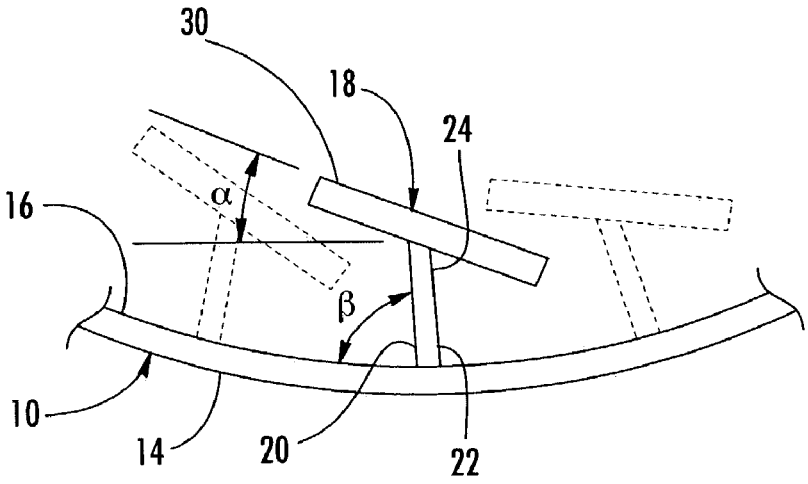
Figure 4:
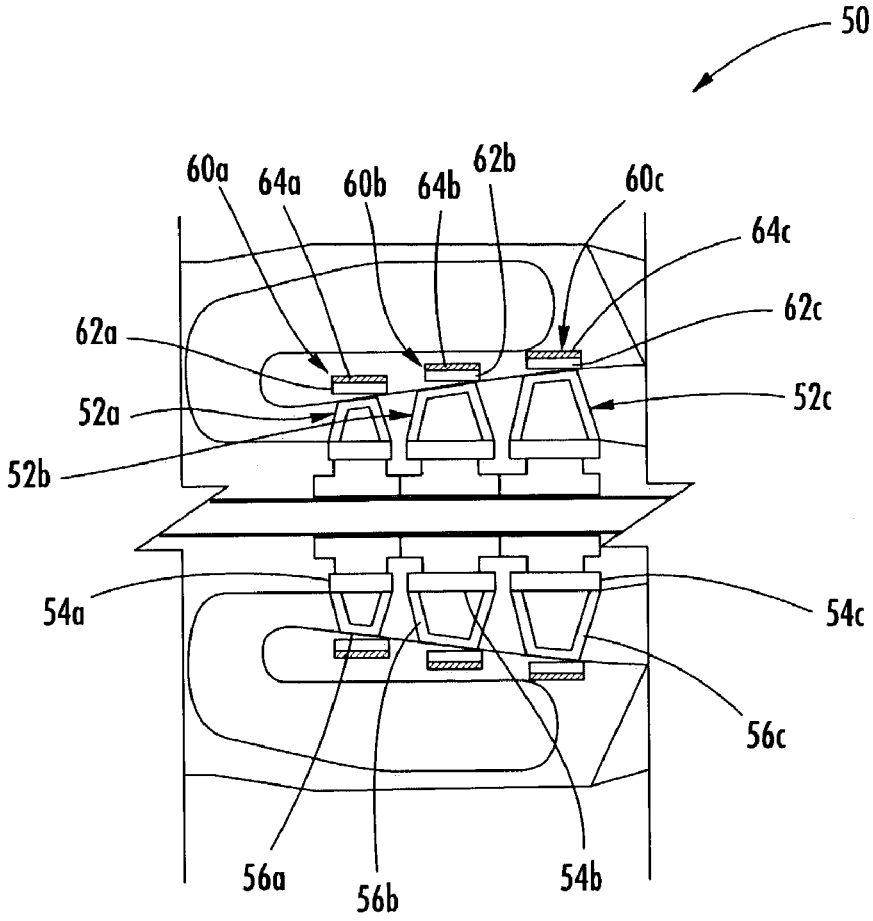

Having thus described the invention in general terms, reference will now be made to the accompanying drawings, which are not necessarily drawn to scale, and wherein:

FIG. 1 illustrates an elevation view of a containment device according to one embodiment of the present invention;

FIG. 2 illustrates a perspective view of the containment device of FIG. 1;

FIG. 3 illustrates an enlarged partial view of the containment device of FIG. 1; and FIG. 4 illustrates a gas turbine with three turbine stages, each having a containment device according to another embodiment of the present invention.

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Referring now to the figures and, in particular, FIGS. 1 and 2, there is shown a containment device 10 for retaining structural fragments, foreign objects, and other material, referred to generally as debris material, traveling from or through a rotary device 12. The containment device 10 of the present invention can be used with a variety of rotary devices 12. For example, the rotary device 12 can be an energy storage unit, a transmission, a gearbox, a turbine, or another rotary device that includes at least one rotatable element 40 such as a flywheel, gear, or turbine rotor 42 with blades 44 extending therefrom, as shown in FIGS. 1 and 2. The rotary device 12 can also include other structural members that do not rotate with the rotatable element 40. The debris material can include structural fragments that are broken from the rotatable element 40 during a failure of the rotary device 12. Alternatively, the debris material can be a foreign object that travels through the rotary device 12, such as part of a tire or a piece of structural material from an airplane that is drawn into a turbine of a jet engine on the airplane. The debris material can have substantial mass and/or velocity and, hence, high kinetic energy.

The containment device 10 includes an outer ring 14 that defines an inner surface 16 directed radially inward. Disposed on the inner surface 16 is a plurality of energy absorption elements 18. The absorption elements 18 can define a variety of shapes and sizes, but each absorption element 18 extends generally radially inward. For example, as shown in FIG. 1, each absorption element 18 has a base 20 and a cap 30, which can be welded or otherwise connected. The base 20 extends generally radially inward, for example, at an angle relative to the radial direction of the outer ring 14. A first end 22 of the base 20 is connected to the outer ring 14. Each cap 30 is attached to a second end 24 of the respective base 20 so that the cap 30 is cantilevered from the base 20 and defines an angle with the base 20.

Thus, the absorption elements 18, which include the bases 20 and caps 30, extend radially inward and also in the circumferential direction of the outer ring 14. By the term "circumferential direction," it is meant that each of the absorption elements 18, e.g., the caps 30 thereof, extend at least partially in a direction perpendicular to the radial direction of the outer ring 14. The absorption elements 18 are also configured in size, shape, and location so that each absorption element 18 overlaps at least one of the absorption elements 18 proximate thereto. As illustrated, the base 20 and cap 30 are generally flat members, i.e., plates, as illustrated in FIGS. 1 and 2, and each base 20 and cap 30 extends substantially in an axial direction of the outer ring 14.

The absorption elements 18 are formed of a material that has sufficient strain energy capability so that the absorption elements 18 can be plastically deformed, or bent, by material that travels radially within the outer ring 14 and collides with one or more of the absorption elements 18. Preferably, the absorption elements 18 are configured to deform at a rate fast enough to prevent localized failure, as is described in U.S. Pat. No. 6,182,531 to Gallagher, the entirety of which is incorporated herein by reference. For example, the absorption elements 18 can be formed of steel, such as carbon steel, stainless steel, or a nickel-chromium-iron alloy such as those belonging to the Inconel® family of alloys, a registered trademark of Huntington Alloys Corporation. That is, the absorption elements 18 can be formed of at least one of the group consisting of carbon steel, stainless steel, and nickel-chromium-iron alloys. The bases 20 and caps 30 can be formed of the same or different materials, and each can have a different size and thickness. For example, each base 20 can be configured to plastically deform to absorb the energy of impact of debris material, and each cap 30 can be configured to resist shear failure so that the debris material does not pierce the caps 30 and travel through the outer ring 14. Preferably, the bases 20 and/or the caps 30 are configured to prevent debris material from piercing the containment device 10 and traveling through the outer ring 14 thereof. For example, the caps 30 and bases 20 can be formed of the same material, with each cap 30 having a greater thickness than the respective base 20 so that the cap 30 prevents debris material from piercing the containment device 10. The absorption elements 18 can also be configured so that if an absorption element 18 is sufficiently deformed by debris material, the absorption element 18 contacts at least one other absorption element 18, thereby spreading the load associated with the debris material over multiple absorption elements 18. The outer ring 14, which can be formed steel or other materials, is preferably sufficiently rigid to support the absorption elements 18 while the absorption elements 18 contain debris material therein. However, the outer ring 14 can alternatively be configured to deform to contain debris.

As shown in FIG. 3, the base 20 of each absorption element 18 can be configured at an angle $\beta$, relative to the tangential direction of the outer ring 14 where the base 20 connects to the outer ring 14. Each cap 30 can be configured at an angle $\alpha$ relative to the same tangential direction. According to one embodiment of the present invention, the angle $\beta$ is between about 35 and 95 degrees, and angle $\alpha$ is between about 0 and 45, degrees. A midpoint of the cap 30 can be connected to the base 20 so that the cap 30 extends equidistant in opposing directions from the base 20. Thus, each cap 30 can define first and second ends, each of which are cantilevered from the respective base 20, and the first end of each cap 30 can extend circumferentially to overlap the second end of the cap 30 of an adjacent absorption member 18. Alternatively, each base 20 can be connected to other portions of the respective cap 30 so that the cap 30 extends a greater distance on one side of the base 20 or even extends in only one direction from the base 20 to form an L-shape with the base 20. Further, one or both of the cap 30 and base 20 of each absorption element 18 can be curved. For example, a curved cap 30 can extend from a generally flat base 20 so that the absorption element 18 defines a hooked or J-shaped member. In any case, the absorption elements 18 can collectively extend continuously circumferentially inside the outer ring 14 to receive debris material that travels radially outward toward the outer ring 14.

FIG. 4 illustrates part of a gas turbine 50, such as an auxiliary power unit, that has three turbine stages 52*a*, 52*b*, 52*c* with containment devices 60*a*, 60*b*, 60*c*. Containment devices according to the present invention can also be used for other turbine devices, such as for the turbines or compressor stages of a jet engine. Each turbine stage 52*a*, 52*b*, 52*c* illustrated in FIG. 4 includes a turbine rotor 54*a*, 54*b*, 54*c* and a blade 56*a*, 56*b*, 56*e*. The rotors 54*a*, 54*b*, 54*c* and blades 56*a*, 56*b*, 56*c* are rotatably mounted in the turbine 50 so that each rotor 54*a*, 54*b*, 54*c* and blade 56*a*, 56*b*, 56*c* can be rotated as air and combustion gases are moved axially through the turbine 50. Each containment device 60*a*, 60*b*, 60*c* includes a plurality of absorption elements 62*a*, 62*b*, 62*c*, such as those described above in connection with FIGS. 1–3, disposed on an outer ring 64*a*, 64*b*, 64*c*. Alternatively, each absorption element 62*a*, 62*b*, 62*c* can be formed of a single flat plate, a curved plate that defines an S-shape or other curves, or other configurations.

The containment devices 60*a*, 60*b*, 60*c*, including the absorption elements 62*a*, 62*b*, 62*c*, can have a length in the axial direction that is longer than the rotor 54*a*, 54*b*, 54*c* and/or the blade 56*a*, 56*b*, 56*c* of the respective turbine stage 52*a*, 52*b*, 52*c* so that debris material produced by the fragmenting of one of the turbine stages 52*a*, 52*b*, 52*c* is likely to travel radially outward and impact with the respective containment device 60*a*, 60*b*, 60*c*. Further, as debris material impacts with the containment device 60*a*, 60*b*, 60*c*, the absorption elements 62*a*, 62*b*, 62*c* are deformed radially and axially. The deformed elements 62*a*, 62*b*, 62*c* can at least partially receive the debris material, thereby restraining the debris from moving axially.

In some embodiments of the present invention, the containment devices may not be located immediately proximate to the outer edge of the rotating element in the rotary device. For example, the positions of the containment devices 60*a*, 60*b*, 60*c* in FIG. 4 are determined, in part, according to the operation of the gas turbine 50. In particular, the distance between the absorption elements 62*a*, 62*b*, 6*k* and an arc defined byte outermost edge of the rotating element, i.e., the turbine blades 56*a*, 56*b*, 56*c*, can be greater than about 1/10 of the diameter of the respective rotating element. The distance between each turbine blade 56*a*, 56*b*, 56*c*, or other rotating element, and the respective containment device 60*a*, 60*b*, 60*c* can be sufficient for a portion of debris material that breaks from the rotating element to partially rotate before contacting the containment device 60*a*, 60*b*, 60*c*, thereby potentially directing a sharp, broken edge toward the containment device 60*a*, 60*b*, 61*c*. In addition, the length of each base can be shorter than a distance between the second end of the base and the arc defined by the path of the at least one blade. Advantageously, the absorption elements 62*a*, 62*b*, 62*c*, e.g., the caps and/or bases thereof, can be sufficiently strong to resist piercing or other severe damage by the debris material, as described above.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A containment device for use in retaining debris material traveling radially outward in a rotary device, the containment device comprising:

an outer ring extending generally circumferentially and defining an inner surface directed radially inward; and a plurality of energy absorption elements disposed on the inner surface of the outer ring, each absorption element extending radially inward and circumferentially such that each absorption element is configured to be plastically deformed radially outward by debris material impacting the absorption element, wherein each absorption element includes a base and a cap, the base extending in a generally radial direction between a first end connected to the inner surface of the outer ring and a second distal end, the cap being connected to the base and defining an angle therebetween, the cap of each absorption element extending between a first end and a second end, the second end of the base being connected to the cap between the first and second ends of the cap.

2. A containment device according to claim 1 wherein the cap of each absorption element extends circumferentially to at least partially overlap an adjacent one of the absorption elements.

3. A containment device according to claim 1 wherein the second end of each cap of each absorption element extends circumferentially to overlap the first end of the cap of an adjacent one of the absorption elements.

4. A containment device according to claim 1 wherein the base of each absorption element defines an angle $\beta$ with a tangential direction of the outer ring at the intersection of the base and the outer ring, and each cap defines an angle $\alpha$ with the tangential direction, the angle $\beta$ being between about 35 and 95 degrees and the angle $\alpha$ being between about 0 and 45 degrees.

5. A containment device according to claim 1 wherein the absorption elements extend generally in an axial direction of the outer ring.

6. A containment device according to claim 1 wherein the absorption elements are formed of at least one of the group consisting of carbon steel, stainless steel, and nickel-chromium-iron alloys.

7. A containment device according to claim 1 wherein the cap of each absorption element is thicker than the base of the respective absorption element.

8. A containment device according to claim 1 wherein the cap of each absorption element is welded to the base of the respective absorption element.

9. A containment device according to claim 1, further comprising a rotatable element mounted within the outer ring, the rotatable element having an outer edge that defines an arcuate path of travel, wherein the distance between the absorption elements and the arcuate path of travel is greater than about 1/10 of the diameter of the rotating element.

10. A containment device according to claim 1, further comprising a rotatable element configured to rotate within the outer ring, the rotatable element having at least one blade extending radially outward.

11. A containment device according to claim 1 wherein the cap and base of each absorption element are flat members.

12. A containment device according to claim 1 wherein the outer ring is configured to be deformed by the debris material.

13. A turbine with a containment device for containing debris material, the turbine comprising:

a rotatable turbine rotor configured to rotate about an axis of rotation;

at least one turbine blade connecting to the turbine rotor and configured to rotate about the axis of rotation with the turbine rotor;

an outer ring extending circumferentially around the turbine rotor and at least one blade, the outer ring defining an inner surface directed radially inward; and a plurality of energy absorption elements disposed on the inner surface of the outer ring, each absorption element extending radially inward and circumferentially such that each absorption element is configured to be plastically deformed radially outward by debris material impacting the absorption element, wherein each absorption element includes a base and a cap, the base extending in a generally radial direction between a first end connected to the inner surface of the outer ring and a second distal end, the cap being connected to the base and defining an angle therebetween, the cap of each absorption element extending between a first end and a second end, the second end of the base being connected to the cap between the first and second ends of the cap.

14. A turbine according to claim 13 wherein each absorption element extends circumferentially to at least partially overlap an adjacent one of the absorption elements.

15. A turbine according to claim 13 wherein the second end of each cap of each absorption element extends circumferentially to overlap the first end of the cap of an adjacent one of the absorption elements.

16. A turbine according to claim 13 wherein the base of each absorption element defines an angle $\beta$ with a tangential direction of the outer ring at the intersection of the base and the outer ring, and each cap defines an angle $\alpha$ with the tangential direction, the angle $\beta$ being between about 35 and 95 degrees and the angle $\alpha$ being between about 0 and 45 degrees.

17. A turbine according to claim 13 wherein the absorption elements extend generally in the axial direction of the rotor.

18. A turbine according to claim 13 wherein the length of each base is shorter than a distance between the second end of the base and an arc defined by the path of the at least one blade.

19. A turbine according to claim 13 wherein the outer ring and the absorption elements have a greater length in the axial direction than the axial length of the rotor and blades.

20. A turbine according to claim 13 wherein each cap of each respective absorption element is thicker than the base of the respective absorption element.

21. A turbine according to claim 13 wherein each absorption element is formed of at least one flat member.

22. A containment device for use in retaining debris material traveling radially outward in a rotary device, the containment device comprising:

an outer ring extending generally circumferentially and defining an inner surface directed radially inward; and a plurality of energy absorption elements disposed on the inner surface of the outer ring, each absorption element extending radially inward and circumferentially such that each absorption element is configured to be plastically deformed radially outward by debris material impacting the absorption element, wherein each absorption element includes a base and a cap, the base extending in a generally radial direction between a first end connected to the inner surface of the outer ring and a second distal end, the cap being connected to the base and defining an angle therebetween, and the cap of each absorption element being thicker than the base of the respective absorption element.

23. A containment device for use in retaining debris material traveling radially outward in a rotary device, the containment device comprising:

an outer ring extending generally circumferentially and defining an inner surface directed radially inward; and a plurality of energy absorption elements disposed on the inner surface of the outer ring, each absorption element extending radially inward and circumferentially such that each absorption element is configured to be plastically deformed radially outward by debris material impacting the absorption element, wherein each absorption element includes a base and a cap, the base extending in a generally radial direction between a first end connected to the inner surface of the outer ring and a second distal end, the cap being connected to the base and defining an angle therebetween, and the cap and base of each absorption element being flat members.

* * * * *

UNITED STATES PATENT AND TRADEMARK OFFICE

CERTIFICATE OF CORRECTION

PATENT NO. : 7,008,173 B2
APPLICATION NO. : 10/630500
DATED : March 7, 2006
INVENTOR(S) : Gabrys et al.

It is certified that error appears in the above-identified patent and that said Letters Patent is hereby corrected as shown below:

Column 5,
Line 5, "56*e*" should read --56*c*--;
Line 35, "6*k*" should read --62*c*--;
Line 36, "byte" should read --by the--;
Line 45, "61*c*" should read --60*c*--.

Signed and Sealed this

Fifteenth Day of August, 2006

JON W. DUDAS
*Director of the United States Patent and Trademark Office*